United States Patent [19]

Kaufman

[11] 4,320,613

[45] Mar. 23, 1982

[54] PROFILED INSULATING UNDERBOARD

[75] Inventor: Donald L. Kaufman, Akron, Ohio

[73] Assignee: Alside, Inc., Akron, Ohio

[21] Appl. No.: 39,796

[22] Filed: May 17, 1979

[51] Int. Cl.[3] ..... E04D 3/361; E04D 1/80

[52] U.S. Cl. ..... 52/521; 52/302; 52/309.8; 52/531; 52/603; 52/748

[58] Field of Search ..... 52/302, 303, 309.8, 52/533, 531, 521, 748, 603

[56] References Cited

U.S. PATENT DOCUMENTS

| | | | |
|---|---|---|---|
| Re. 24,246 | 12/1956 | Fink et al. | 52/553 X |
| 2,096,265 | 10/1937 | Strong . | |
| 2,114,362 | 4/1938 | Tashjian . | |
| 2,183,450 | 12/1939 | Frlangeri | 52/603 X |
| 2,273,775 | 2/1942 | Strong . | |
| 2,316,345 | 4/1943 | Logan, Jr. . | |
| 2,598,262 | 5/1952 | Janson | 52/603 |
| 2,724,872 | 11/1955 | Herbes | 52/302 |
| 2,899,716 | 8/1959 | Woodward | 52/533 X |
| 3,001,332 | 9/1961 | Wilder | 52/303 |
| 3,110,130 | 11/1963 | Trachtenberg . | |
| 3,158,960 | 12/1964 | Newton et al. . | |
| 3,159,943 | 12/1964 | Sugar et al. . | |
| 3,214,876 | 11/1965 | Mattes | 52/520 |
| 3,233,382 | 2/1966 | Graveley, Jr. | 52/522 |
| 3,248,835 | 5/1966 | Westlind | 52/404 |
| 3,420,024 | 1/1969 | Salvo | 52/316 |
| 3,496,058 | 2/1970 | Schroter . | |
| 3,826,054 | 7/1974 | Culpepper, Jr. | 52/309.8 |
| 3,998,021 | 12/1976 | Lewis | 52/531 |
| 4,104,841 | 8/1978 | Naz | 52/531 X |

FOREIGN PATENT DOCUMENTS

| | | | |
|---|---|---|---|
| 2447489 | 4/1976 | Fed. Rep. of Germany | 52/531 |
| 2454882 | 5/1976 | Fed. Rep. of Germany | 52/603 |
| 653579 | 5/1963 | Italy | 52/531 |
| 1165065 | 9/1969 | United Kingdom | 52/302 |

*Primary Examiner*—Alfred C. Perham
*Attorney, Agent, or Firm*—Reese Taylor

[57] ABSTRACT

A profiled insulating underboard for insulating and aligning metal or plastic siding panels is disclosed. The underboard is formed from a suitable insulating material into a sheet having one substantially flat planar surface and an opposed surface with a configuration or profile which corresponds to the inner contour or profile of the siding panel so that it will fit snugly against the inner surface of the siding when installed. Each sheet of underboard, which is received against the exterior wall surface of a building, has a series of integral projections spaced along one longitudinal edge surface so that adjacent sheets are automatically spaced from each other to permit ventilation and help prevent moisture build up once the underboard and the siding have been fixed to the exterior surface of the building.

7 Claims, 5 Drawing Figures

PROFILED INSULATING UNDERBOARD

FIELD OF THE INVENTION

This invention, in general, relates to the application of protective and decorative siding material to the exterior surfaces of buildings and in particular relates to an improved insulating underboard intended to be applied between the surface of the building and conventional metal or plastic siding panels.

DESCRIPTION OF THE PRIOR ART

It is well known in the construction and home improvement industries to provide siding panels of metal or plastic which can be nailed or otherwise affixed to the exterior surface of a building for protective and decorative purposes. An example of siding of this general type can be seen in Gravely U.S. Pat. No. 3,233,382 wherein a series of siding panels are applied to a wall surface in interlocking relationship with each other.

Some attempts have also been made to provide for insulation in addition to that provided by the siding per se. One example of these attempts can be seen in Culpepper U.S. Pat. No. 3,826,054 wherein a building sheathing having insulating qualities is attached to the outside surface of the building to help form a support for the exterior wall siding and to provide a snap-on attachment base for the siding.

Newton U.S. Pat. No. 3,158,960 discloses the provision of a weather and wear resistant covering readily clipped on the outward face of individual siding panels constructed of insulating material such as fiberboard or wood.

Logan U.S. Pat. No. 2,316,345 discloses an outside covering for buildings constructed of a base material placed in contact with the exterior surface of the building and having a decorative outer surface.

Tashjian U.S. Pat. No. 2,114,362 is essentially directed to roof construction, but does disclose the utilization of metal encased shingles presumably having insulating properties.

Strong U.S. Pat. No. 2,096,265 discloses a composite structure including a recessed element and a closure element which are assembled together with the space between those two elements being filled with an insulating material. Strong U.S. Pat. No. 2,273,775 discloses a similar structural unit comprising a body shell filled with insulating material.

Trachtenberg U.S. Pat. No. 3,110,130 discloses the provision of an insulating board or layer of material adhesively adhered behind each individual length of siding panel.

Westlind U.S. Pat. No. 3,248,835 also discloses an insulated backing which may be applied to the inner side of each siding panel.

Schroter U.S. Pat. No. 3,496,058 discloses a metallic and foam laminate including a metallic layer and a semi-elastomeric layer laminated together.

Lewis U.S. Pat. No. 3,998,021 discloses an insulated siding panel assembly in which a backing member is provided with a reinforcing rib and is secured behind each individual siding sheet.

Sugar U.S. Pat. No. 3,159,943 is another example of a composite siding member in which an aluminum sheet or siding panel has an insulating material laminated to its inner surface.

Mattes U.S. Pat. No. 3,214,876 discloses the utilization of a sheet of insulation material behind each outer siding panel sheet. Salvo U.S. Pat. No. 3,420,024 is similar in that it discloses a plastic laminate applied to an insulating base member.

The present invention, while essentially being directed toward the same general objective as the prior art just discussed, namely the achievement of improved insulation in connection with the application of metal or plastic siding, is believed to possess a number of advantages thereover.

SUMMARY OF THE INVENTION

Thus it has been found that conventional metal or plastic siding panels can have their efficiency significantly improved by the utilization of a unique profiled insulating underboard.

It has been discovered that this underboard can be produced in large sheets having one substantially uninterrupted flat planar surface and an opposed profiled surface. It has further been discovered that the profiling can be such that it would normally correspond to the inner contour or profile of the siding panels. The sheets can be profiled in multiples of the siding dimensions so that each sheet will cooperate with a plurality of siding panels. These sheets can then be placed on a vertical wall surface and held temporarily in place. Once the sheets are thus located on the wall surface, the paneling can then be installed in conventional fashion against the profiled surface thereby also permanently securing the underboard to the wall and effectively insulating the panels. This permits maximization of the insulation properties while minimizing the extent of projection from the original wall surface.

It has also been found that utilization of sheets of insulating underboard of the type disclosed herein permits irregularities in the wall surface to be eliminated or compensated for. Specifically, it is well known that a conventional exterior wall surface will often have concavities or convexities therein. It has been discovered that utilization of a profile insulated underboard of the type disclosed herein permits these irregularities to be effectively eliminated so that the siding, when installed on the underboard, will present a true surface on its exterior thereby enhancing the appearance of the building.

It has also been found that each sheet of the underboard which is disclosed herein can be provided with a series of projections along one longitudinal edge thereof so that adjacent sheets are effectively spaced from each other. In this regard, it is well known that moisture will migrate from the interior of a building toward the exterior through the walls and it has been found that by providing these spacing projections that this moisture will be permitted to escape and be evaporated or passed into the exterior atmosphere through the normal weep holes in most siding panels themselves.

Accordingly, production of an improved profiled insulating underboard of the type just described becomes the principal object of this invention with other objects thereof becoming more apparent upon a reading of the following brief specification considered and interpreted in view of the accompanying drawings.

THE DRAWINGS

DESCRIPTION OF THE PREFERRED EMBODIMENTS

Figure 1:
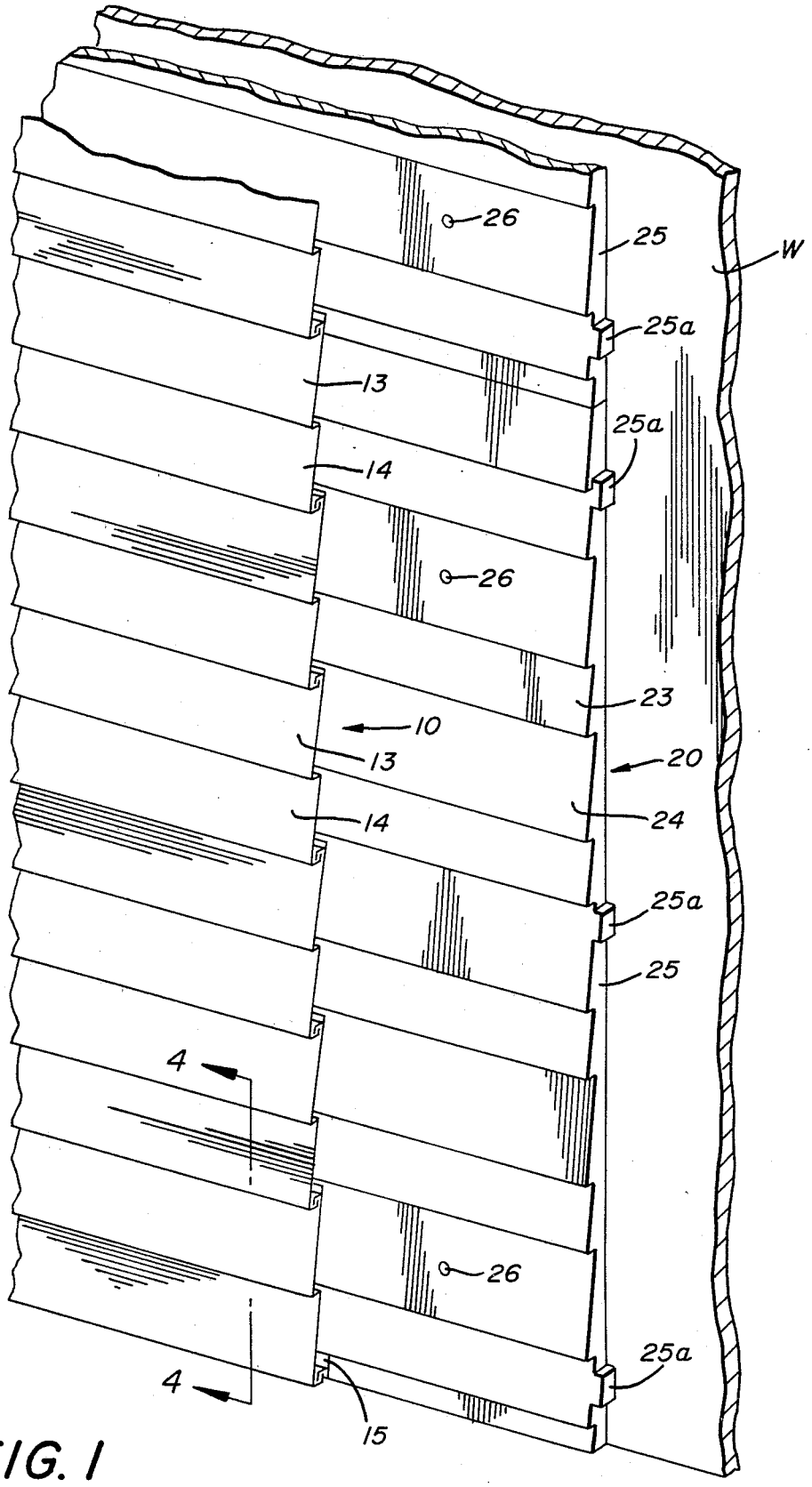
FIG. 1 is a partial perspective view showing a portion of the wall, a portion of the underboard sheet and a portion of the siding panels.
Figure 2:
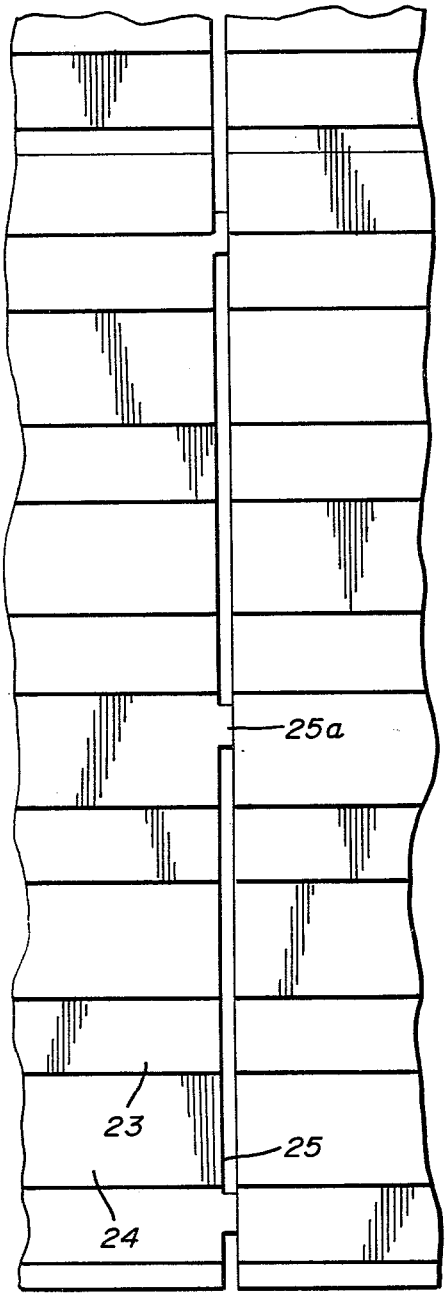
FIG. 2 is a partial elevational view showing abutting sheets of underboard of FIG. 1.
Figure 5:
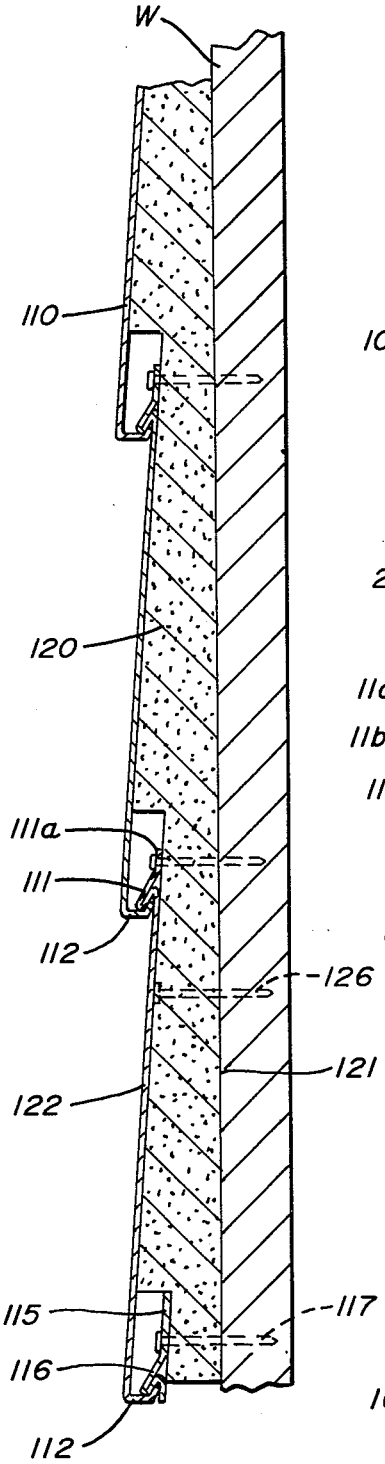
FIG. 5 is a partial sectional view taken along the line 5—5 showing the panels and underboard of FIG. 3 secured to the wall surface.
Figure 4:
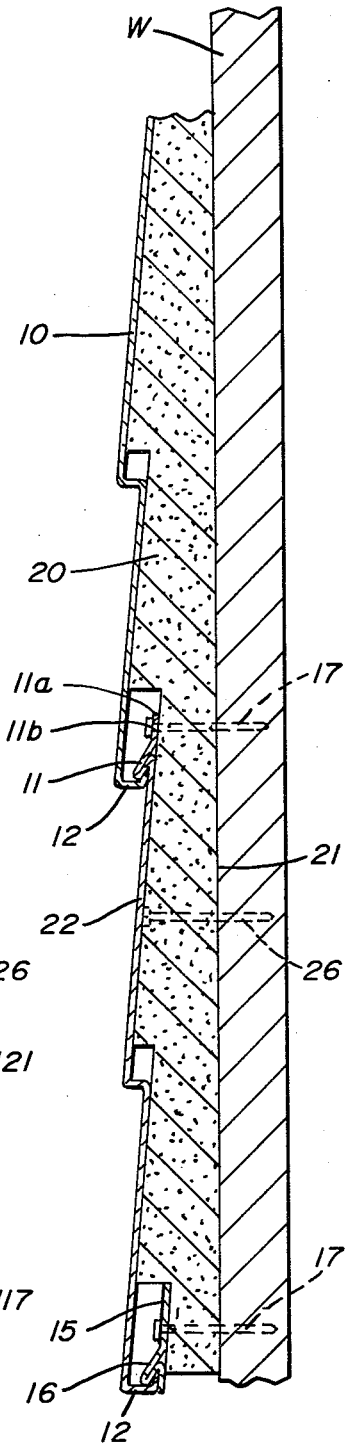
FIG. 4 is a partial sectional view taken along the line 4—4 of FIG. 1 showing the panels and the underboard secured to the wall surface.
Figure 3:
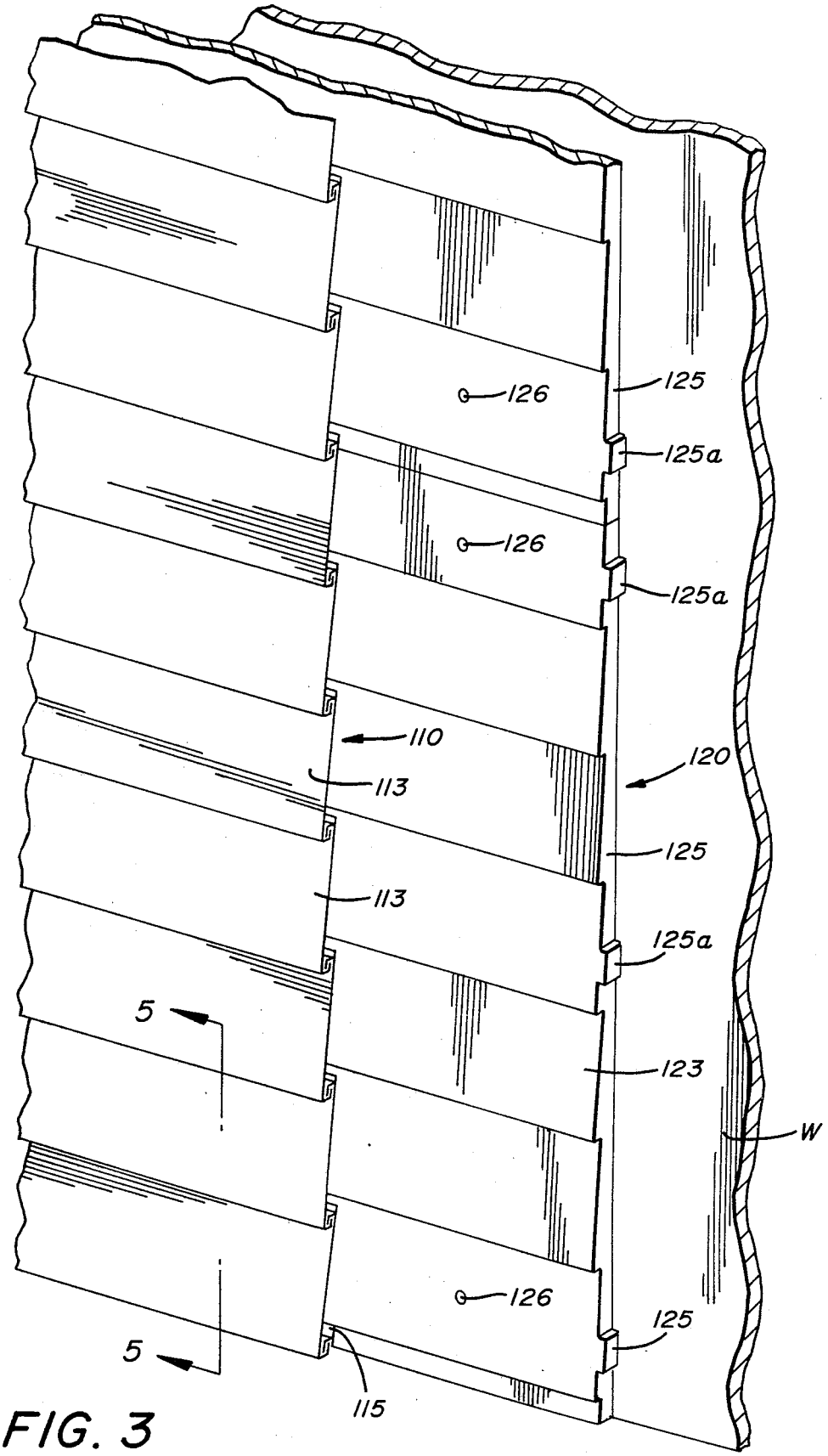
FIG. 3 is a partial perspective view similar to FIG. 1 showing a modified configuration of the underboard and the siding.

Before describing the drawing figures in detail, it should be noted that FIGS. 1, 2 and 4 illustrate one style of underboard while FIGS. 3 and 5 illustrate another although both involve the same inventive principle. FIGS. 1, 2 and 4 illustrate what is commonly called a "Double-Wide" configuration wherein each siding panel has two courses each approximately five inches high. FIGS. 3 and 5 illustrate what is commonly called a "Standard 8" configuration wherein the paneling consists of a single course approximately eight inches high. The underboard illustrated in the drawings is intended to accommodate these varying types of siding, but it should be understood that it is not in any way intended to be limited to any particular dimension or configuration other than that it will be designed to mate with whatever conventional siding style is to be used.

Turning then to FIGS. 1 and 4, it will be noted that the siding illustrated therein and generally indicated by the numeral 10 is a generally rectangular metal or plastic piece such as is well known in this art and having two horizontally extending courses 13 and 14. Extending along the top edge surface of course 13 is a connecting flange 11 and nailing strip 11*a* having suitable nail receiving openings 11*b*.

Received along the bottom edge of course 14 is a return element 12 suitable for engagement with the connecting flange 11 of the top edge as clearly shown in FIGS. 1 and 4 of the drawings. The manner of interconnecting one panel of siding with another is well known in this art and one example is shown in Gravely U.S. Pat. No. 3,233,382 and will not be discussed in detail herein.

Also illustrated in FIGS. 1 and 4 is a starter strip 15 which has nail receiving holes and a connecting flange 16 similar to connecting flange 11 of the siding panels.

The underboard of FIG. 1, generally indicated by the numeral 20, comprises a generally rectangular sheet of a suitable plastic foam or insulation medium such as, for example, expanded polystyrene. In that regard, any suitable material of this nature which is capable of being molded and shaped and has the required insulating properties could be utilized and the invention is not limited to any specific material so long as the material possesses these characteristics.

Referring to FIG. 4, it will be seen that the underboard 20 has, on one side, a generally flat planar surface 21 and an opposed contoured or profiled surface 22 on the other side which is shaped in series of courses 23 and 24 which are complemental to the courses 13 and 14, for example, of the siding 10.

The rear planar surface 21 is suitable for mounting against the wall W while the forward profiled surface 22 is suitable for snug engagement with the inner surface of the siding 10 as will be described.

Referring again then to FIGS. 1, 2 and 4, it will also be noted that each sheet of the underboard has a series of vertically spaced, laterally extending projections 25*a*,25*a* disposed along one edge surface 25 thereof. The purpose and function of these projections will be described hereafter.

In using the improved profiled insulating underboard it is first necessary to temporarily secure the sheet 20 to the wall surface W. This is achieved with only minimal attachment by any desired means such as nails 26 since the siding 10 is intended to be installed conventionally and will itself provide the means of final attachment to the wall surface W. The precise overall dimensions of the sheet 20 are not critical, but it is contemplated that they will be such that they cover a relatively large wall area so as to accommodate a plurality of siding panels in contrast to the "one to one" arrangement of most of the prior art wherein each siding panel is individually insulated.

Once the underboard 10 has been temporarily attached to the wall, starter strip 15 is secured to the bottom of the underboard as shown in FIG. 4 by nails 17. This provides a point of engagement for the first siding panel 20 so that connecting flange 16 of starter strip 15 engages return element 12 of the first siding panel.

Following this, it is a simple matter to install the remaining siding panels 10 in conventional fashion with the nails 17 which are applied through the holes 11*b*,11*b* in the nailing strip 11*a* passing completely through the underboard and securing it to the wall surface. Alignment of the individual siding panels is also automatic since that will be controlled by the location of courses 23,24 of the underboard.

FIG. 1 illustrates one sheet of underboard 10 and part of another. It will be understood that the uppermost board can be cut or trimmed as required depending on the height of the wall being treated.

It will also be noted that edges of adjacent sheets of the underboard 20 will be spaced from each other slightly due to the engagement of projections 25,25 with edge surface 27. As is well known, moisture does seep out from the interior of a house through the walls. The foam material of which the underboard 20 is constructed will serve as a barrier to this and if not relieved in some fashion the condensed moisture could cause structural damage or other undesirable effects. Therefore, the projections 25*a*,25*a* provide predetermined spacing between adjacent sheets of the underboard so that the moisture vapor can pass out of the walls and be relieved through the weep holes which are conventionally provided in the bottom return 12 of most siding panels.

With respect to the form of the invention shown in FIGS. 2 and 5, it has already been pointed out that this installation is essentially the same as that shown in FIGS. 1 through 3 except that each siding panel 110 simply comprises one course 113 and the underboard 120 is contoured so as to mate with them. Underboard 120 also has the projections 125*a*, 125*a* extending from edge 125 which will serve to space adjacent sheets from each other to permit the ventilation and moisture removal described above with regard to the form of the invention illustrated in FIGS. 1, 2 and 4.

These siding panels 110 also have a connecting flange 111 and nailing strip 111*a* on their top edges and a return element 112 on their bottom edges. Also, a starter strip 115 is provided for interconnection with the first panel 110. Furthermore, the underboard 120 is temporarily secured to the wall W by nails 126 and the siding panels by nails 117. Installation is accomplished as described in connection with FIGS. 1, 2 and 4.

As noted earlier, the invention is not intended to be limited to any particular material and could be comprised of any moldable plastic foam although most other insulation mediums could be employed so long as they are capable of being shaped or molded to the desired configuration.

It will also be noted that the underboard 20 and 120 could be temporarily secured to the wall surface W in any desired fashion such as by nailing, stapling or gluing. In this regard, the underboard is installed with only a minimal attachment since the installation of the siding is conventional and that installation accomplishes the final attachment of the overall structure to the wall surface. It is only necessary, therefore, to attach the underboard sufficiently so as to keep it in place until the siding is nailed on.

It will also be noted that no difficulties will be encountered with alignment of the siding 10 and 110 because of the fact that the profiled surfaces 22 and 122 of the underboard will serve to automatically locate the siding panels 10 and 110 in their proper orientation.

Furthermore, there is no difficulty with regard to calculating and providing the necessary spacing between adjacent sheets for moisture removal because the projections 25*a* and 125*a* will automatically provide for that requirement.

Finally, it will be noted that, by provision of the relatively rigid underboard sheets 20 and 120 with their substantially uninterrupted planar rear surfaces 21 and 121, any irregularities such as a concavity, for example, in the wall W will be compensated for and the siding 10 and 110 will present and be disposed in a true plane once it is installed, with the underboard making up for or accommodating any irregularities in the building surface.

While a full and complete description of the invention has been set forth in accordance with the dictates of the Patent Statutes, it should be understood that modifications can be resorted to without departing from the spirit hereof or the scope of the appended claims.

For example, it should again be noted that while certain relative dimensions have been shown in the versions of the invention shown in FIGS 1, 2 and 4 and FIGS. 3 and 5, that these are solely to accommodate conventional configurations of siding and that any other variations would be readily possible within the scope of this invention.

What is claimed is:

1. In combination with a building presenting an external support surface, a wall covering system for the building, comprising:

(A) at least one sheet of insulating material having
  (1) a generally rectangular planar configuration,
  (2) a substantially flat rear surface, and
  (3) a profiled outer surface;

(B) a plurality of siding panels each having a connecting flange and a nailing strip on its top edge and a return element on its bottom edge;

(C) said profiled outer surface of said sheet of insulating material being contoured complementally with the inner surfaces of said siding panels;

(D) attachment means passing through said siding panels and said insulating material and engaging said support surface to secure said siding panels and said insulating material to said support surface; and (E) said sheet of insulating material having a series of laterally extending, integral projections on one longitudinal edge surface.

2. Profiled, insulating underboard and attachment means for use with standard siding panels and a support surface, comprising:

(A) a sheet of insulating material having
  (2) a generally rectangular planar configuration with opposed top and bottom surfaces interconnected by opposed edge surfaces,
  (2) a substantially flat rear surface,
  (3) a profiled outer surface contoured complementally with the inner surface of the siding panels, and
  (4) a plurality of laterally extending integral projections on at least one edge surface
    (a) whereby laterally adjacent sheets may be mechanically spaced from and aligned with each other a distance equal to the length of said projections; and (B) the attachment means being adapted to pass through the siding panels and said sheet of insulating material and engage the support surface to secure the siding panels and said insulating material to said support surface.

3. Profiled, insulating underboard and attachment means for use with a support surface and a standard siding panel having a connecting flange and nailing strip on its top edge, a return element on its bottom edge and a single course interconnecting said connecting flange and said return, comprising:

(A) a sheet of insulating material having
  (1) a generally rectangular planar configuration,
  (2) a substantially flat rear surface, and
  (3) a profiled outer surface including
    (a) a plurality of courses each approximating the length of the single course of the siding panel between the connecting flange and the return;

(B) the attachment means being adapted to pass through said siding panels and said sheet of insulating material and engage the vertical support surface to secure said siding panels and said insulating material to said support surface;

(C) wherein each of said courses of said sheet extends away from the plane of said rear surface from its top edge to its bottom edge and has a bottom return edge disposed substantially normal to the plane of said sheet; said bottom return edge merging with the top edge of the next adjacent course; and (D) said sheet of insulating material has a series of laterally extending integral projections on one longitudinal edge surface.

4. Profiled, insulating underboard and attachment means for use with a support surface and a siding panel having a connecting flange and nailing strip on its top edge, a return element on its bottom edge and two identical courses interconnecting the connecting flange and the return, comprising:

(A) a sheet of insulating material having
  (1) a generally rectangular planar configuration,
  (2) a substantially flat rear surface, and
  (3) a profiled outer surface including
    (a) a plurality of courses each being subdivided into two courses and approximating the length of the two courses of the siding panel between the connecting flange and the return;

(B) the attachment means being adapted to pass through said siding panels and said sheet of insulating material and engage the vertical support surface to secure said siding panels and said insulating material to said support surface;

(C) each of said courses of said sheet extends away from the plane of said rear surface from its top edge to its bottom edge and has a bottom return edge disposed substantially normal to the plane of said sheet; said bottom return edge merging with the top edge of the next adjacent course; and (D) said sheet of insulating material has a series of laterally extending integral projections on one longitudinal edge surface.

5. Profiled, insulating underboard and attachment means for use on a support surface with a standard siding panel having a connecting flange and nailing strip on its top edge, a return element on its bottom edge, and a single course interconnecting said connecting flange and said return, comprising;

(A) a sheet of insulating material having (1) a generally rectangular planar configuration, (2) a substantially flat rear surface, and (3) a profiled outer surface including (a) a plurality of courses each approximating the width of the single course of a siding panel between the connecting flange and the return;

(B) the outer surface of each of said courses sloping away from the plane of said rear surface from its top edge to its bottom edge and having a bottom return surface disposed horizontally and substantially normal to the plane of said sheet, said bottom return surface joining the bottom edge of one course with the top edge of the next adjacent course;

(C) a series of laterally extending integral projections on one longitudinal edge surface; and (D) the attachment means being adapted to pass through said siding panels and said sheet of insulating material and engage the vertical support surface to secure said siding panels and said insulating material to said support surface.

6. Profiled, insulating underboard and attachment means for use on a support surface with a siding panel having a connecting flange and nailing strip on its top edge, a return element on its bottom edge and two identical sub-courses interconnecting the connecting flange and the return, comprising:

(A) a sheet of insulating matering having (1) a generally rectangular planar configuration, (2) a substantially flat rear surface, and (3) a profiled outer surface including (a) a plurality of courses each being sub-divided into two sub-courses and approximating the combined width of the two sub-courses of a siding panel between the connecting flange and the return;

(B) the outer surface of said sheet sloping away from the plane of said rear surface from its top edge to an intermediate point and having a first return surface disposed horizontally and substantially normal to the plane of said sheet, said outer surface then sloping away from the plane of said sheet to the bottom edge of said course, a second return surface disposed horizontally and substantially normal to the plane of said sheet and joining the bottom edge of one course with the top edge of the next adjacent course; said bottom return edge merging with the top edge of the next adjacent course;

(C) said sheet of insulating material having a series of laterally extending integral projections on one longitudinal edge surface; and (D) the attachment means being adapted to pass through said siding panels and said sheet of insulating material and engage the vertical support surface to secure said siding panels and said insulating material to said support surface.

7. A method of installing and insulating standard siding on a planar wall surface comprising the steps of (A) temporarily applying a sheet of insulating underboard having a planar rear surface and a contoured outer surface to a wall surface with said rear surface of said sheet in substantial contact with said wall surface;

(B) temporarily applying laterally adjacent sheets of insulating underboard to the wall surface until said surface is substantially covered and controlling the spacing between said sheets by means of integral edge projections on said sheets;

(C) securing a plurality of siding panels to each other, to said contoured outer surface of said sheets and to said wall surface by passing attachment means through said siding panels and said sheets and into engagement with the wall surface to permanently secure said underboard and said siding to said wall surface; and (D) securing a plurality of siding panels to each other and to said remaining sheets.

* * * * *